US006676380B2

(12) United States Patent
Davis et al.

(10) Patent No.: US 6,676,380 B2
(45) Date of Patent: Jan. 13, 2004

(54) TURBINE BLADE ASSEMBLY WITH PIN DAMPERS

(75) Inventors: Gary A. Davis, Camarillo, CA (US); Gary E. Tuttle, West Hills, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/120,584

(22) Filed: Apr. 11, 2002

(65) Prior Publication Data

US 2003/0194324 A1 Oct. 16, 2003

(51) Int. Cl.[7] ..... F04D 5/26
(52) U.S. Cl. ..... 416/230; 416/229 A; 416/500
(58) Field of Search ..... 416/224, 229 R, 416/229 A, 230, 234, 500

(56) References Cited

U.S. PATENT DOCUMENTS 2,349,187 A * 5/1944 Meyer ..... 416/190
2,809,802 A * 10/1957 Suits ..... 416/230
2,930,581 A * 3/1960 Klint ..... 416/219 R
2,999,669 A * 9/1961 McGinnis ..... 416/229 R
4,484,859 A 11/1984 Pask et al.
5,165,860 A 11/1992 Stoner et al.
5,232,344 A 8/1993 El-Aini
5,407,321 A 4/1995 Rimkunas et al.
5,498,137 A 3/1996 El-Aini et al.
5,820,343 A 10/1998 Kraft et al.
6,155,789 A * 12/2000 Mannava et al. ..... 416/241 R
6,283,707 B1 9/2001 Chin

FOREIGN PATENT DOCUMENTS

DE 2 078 310 A 6/1980

* cited by examiner

*Primary Examiner*—Ninh H. Nguyen
(74) *Attorney, Agent, or Firm*—Black Lowe & Graham

(57) ABSTRACT

A turbine blade assembly for a turbine assembly includes a turbine blade having a turbine blade damper cavity formed therein and a plurality of pins positioned within the turbine blade damper cavity. The pins are maintained in the damper cavity during operation of the turbine blade assembly. They reduce vibration of the turbine blade assembly during operation by dissipating energy by friction between adjacent pins and between the pins and the internal surface of the blade that defines the damper cavity.

94 Claims, 1 Drawing Sheet

TURBINE BLADE ASSEMBLY WITH PIN DAMPERS

BACKGROUND OF THE INVENTION

1. Field of the Invention

The present invention relates to turbines and, more particularly, to the vibration damping of turbine blades thereof.

2. Description of the Related Art

Turbines are commonly used to provide power to pump fluids, move vehicles, or generate electricity. The main power-producing component of a turbine is the turbine blade. Turbine blades are aerodynamically shaped vanes connected to the perimeter of a disk that rotates on a shaft. The blades are shaped so that, when a driving fluid passes over the surface, a force is generated causing the disk to rotate. They are usually manufactured as separate components that are subsequently attached to the disk by various means. Recently, however, turbine blades have been machined as integral parts of the disk. This one-piece integral blade/disk design is commonly referred to as a blisk.

During operation, turbine blades are subjected to alternating fluid forces that can cause high cycle fatigue failure, particularly if the frequency of the alternating force coincides with one of the natural vibration frequencies of the blade. In many instances, vibration dampers have been used to reduce the magnitude of the dynamic stresses, thereby increasing operational life. Most turbine blade vibration dampers consist of small metallic pieces that form a connection between two adjacent blades. Blade vibration causes motion at the blade/damper interfaces resulting in energy dissipation by friction. Since blisks consist of a single piece with no joints to dissipate vibration energy, they are particularly sensitive to operation near the natural frequencies of the blade/disk system. Turbine blades are designed to avoid primary resonant points but it is impossible to prevent this operation at all of the many blade natural frequencies. Therefore, additional damping must be provided to reduce resonant response of the blade/disk system.

Previous attempts to limit dynamic stresses within turbine blades have been disclosed in the patent literature. For example, U.S. Pat. No. 5,232,344, issued to Y. M. El-Aini, discloses a twisted hollow fan or compressor airfoil blade that extends radially from the rotor shaft. It has a plurality of internal chambers, each one bounded by the blade skin on two sides. A slug is located within at least one of these chambers, with the slug under the influence of centrifugal force in contact with the outboard section and also with one of the skins. It is in contact with the skins at two transversely spaced locations so that friction occurs between the two components.

U.S. Pat. No. 5,498,137, issued to Y. M. El-Aini et al., discloses a rotor blade for a turbine engine rotor assembly comprising a root, an airfoil, a platform, and apparatus for damping vibrations in the airfoil. The airfoil includes a pocket formed in a chordwise surface. The apparatus for damping vibrations in the blade includes a damper and a pocket lid. The damper is received within the pocket between an inner surface of the pocket and the pocket lid. The pocket lid is attached to the airfoil by conventional attachment apparatus and contoured to match the curvature of the airfoil.

U.S. Pat. No. 5,820,343, issued to R. J. Kraft et al., discloses a rotor blade for a rotor assembly that includes a root, an airfoil, a platform, and a damper. The airfoil includes at least one cavity. The platform extends laterally outward from the blade between the root and the airfoil, and includes an airfoil side, a root side, and an aperture extending between the root side of the platform and the cavity within the airfoil. The damper, which includes at least one bearing surface, is received within the aperture and the cavity. The bearing surface is in contact with a surface within the cavity and friction between the bearing surface and the surface within the cavity reduces vibration of the blade.

U.S. Pat. No. 5,165,860, issued to A. W. Stoner et al., discloses a turbine blade with an internal damper that comprises an elongated member with a damping surface of discrete width in contact with an interior surface of the blade. This contact is continuous throughout a contact length greater than 50% of the effective radial length. The contact is in the direction having a radial component with respect to the axis of the rotor, preferably with the damper extending between 2 degrees and 30 degrees from the radial direction. This damping surface is the exclusive frictional contact between the damper and the blade.

U.S. Pat. No. 4,484,859, issued to G. Pask et al., discloses an airfoil having a hollow portion at its tip and an internal surface of the hollow portion extending across the direction of centrifugal force acting on the blade in operation. The damper consists of a weight carried adjacent to the internal surface and free to bear on the surface under the action of centrifugal force. Should the blade vibrate, sliding movement may take place between the weight and the surface whereby the vibration of the blade is reduced.

U.S. Pat. No. 5,407,321, issued to D. A. Rimkunas et al., discloses the use of an elongated spring-like damper element that is shaped in the cross section of a "V" or "U" and inserted through a hole formed on one end of the ends of an airfoil of a stator vane. The legs of the "V" or "U" shaped element are adapted to bear against the inner surface of the airfoil and provide damping through frictional loss during vibration.

U.S. Pat. No. 6,283,707, issued to K. Chin, discloses a damper for an airfoil blade that comprises an elongated member that is inserted within a core passage in the blade. The damper is retained in the blade at the end closest to the blade root with the remainder of the damper free to move relative to and within the passage. The damper comprises a resilient plate insert upon which there are provided at least two discrete, oppositely directed, contact regions which are arranged to frictionally engage the passage.

Another proposed damping arrangement is described in GB 2078,310. In this proposal a pin is introduced within a slightly off radial extending passage provided in the airfoil portion of a blade. The pin is retained at the blade root end while being free to slide within the passage. Vibration of the blade causes relative sliding movement of the pin within the passage. Friction generated by the sliding movement absorbs energy and reduces vibration of the blade. The damping provided by this arrangement is achieved by contact between a single pin and an interior passage within the blade. The single pin must be closely fit to the passage and oriented at an angle to the radial direction so that a component of centripetal acceleration will force the pin to contact the wall of the passage.

SUMMARY OF THE INVENTION

The present invention is a turbine blade assembly for a turbine assembly. In a broad aspect, the turbine blade assembly includes a turbine blade having a turbine blade damper cavity formed therein. A plurality of pins are positioned within the turbine blade damper cavity and are maintained there during operation of the turbine blade assembly. The pins reduce vibration of the turbine blade assembly during operation by dissipating energy through friction between the adjacent pins and between the pins and internal surface of the blade that defines the damper cavity.

This invention minimizes turbine blade high cycle fatigue failures by adding damping to reduce dynamic stresses. Damping is obtained through energy dissipation by friction in the internally mounted bundle of small pins. In a preferred embodiment, the pins are held in place by a cap on the outer portion of the hole. During blade vibration, the pins move relative to each other and have been shown to reduce vibration stresses by as much as a factor of 25.

Most turbine blade dampers consist of separate elements that span between two adjacent blades. They provide damping by friction during relative motion of the blades. These designs are not used when the blade and disk are machined as a single entity (blisk) because the blades cannot be individually removed to install the dampers. The present invention is compatible with blisk configurations since the damper is completely contained within a single blade and does not span between adjacent blades. It is not limited to blisks and can also be used in conventional turbines where the individual blades are mechanically attached to the disk.

Other objects, advantages, and novel features will become apparent from the following detailed description of the invention when considered in conjunction with the accompanying drawings.

BRIEF DESCRIPTION OF THE DRAWINGS

The same parts or elements throughout the drawings are designated by the same reference characters.

DETAILED DESCRIPTION OF THE INVENTION

Figure 1:
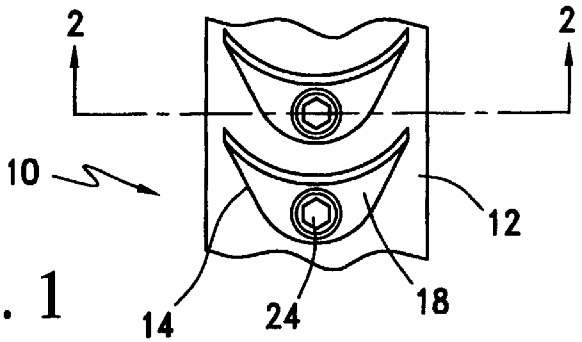
FIG. 1 is an end view of a preferred embodiment of the turbine blade assembly of the present invention.
Figure 2:
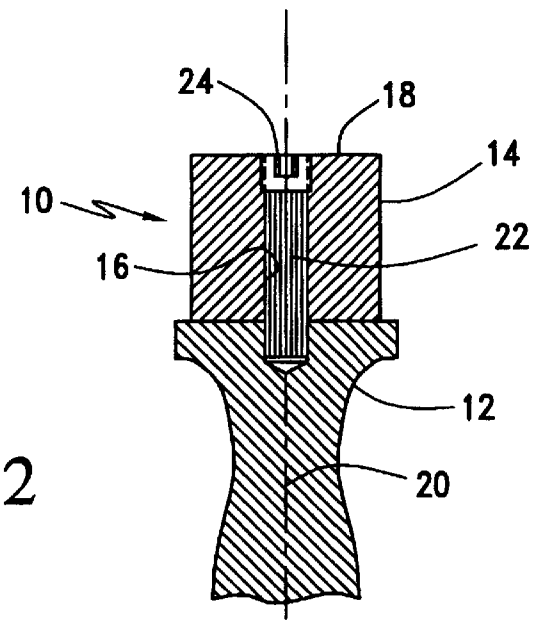
FIG. 2 is a cross-sectional view of the embodiment of FIG. 1, shown along Line 2—2 of FIG. 1.

Referring now to the drawings in the character's reference marked thereon, FIGS. 1 and 2 illustrate a preferred embodiment of the turbine blade assembly of the present invention, designated generally as 10. The turbine blade assembly 10 includes a turbine disk 12 that supports a turbine blade 14. The turbine blade 14 has an internal surface 16 defining a turbine blade damper cavity. The turbine blade damper cavity 16 extends from an opening in the distal end, i.e. tip 18, of the turbine blade 14 opposite the turbine disk 12. Damper cavity 16 may, for example, be cylindrical and extend into the turbine blade 14 substantially parallel to or along a longitudinal axis 20 of the turbine blade 14. The turbine blade longitudinal axis 20 extends substantially radially outward, i.e. radial outward or near radial outward, from the central axis of the turbine. Thus, the turbine blade longitudinal axis 20 extends in a range of about 0°–10° from the radially outward direction from the central axis. The turbine blade damper cavity 16 extends in a range of about 0°–45° from the turbine blade longitudinal axis 20.

Pins 22 are positioned within the turbine blade damper cavity 16. The pins may have circular cross-sections but are not restricted to be of circular cross-section. They can be square, hexagonal or any other suitable shape that dissipates energy by friction within the pin bundle as well as between the walls of the cavity 16 and the outer pins in the pin bundle.

The pins 22 may be formed of any metallic or non-metallic material. They generally have diameters in a range of about 0.010–0.050 inches, preferably about 0.020 inches. They are preferably fitted within the cavity 16 sufficiently to provide a snug fit. The shape of the turbine blade damper cavity 16 and number of pins 22 is dictated by the turbine blade geometry. The turbine blade damper cavity 16 is capped after installation of the pins 22 by a damper cavity cap 24 that is firmly held into position by either screw threads, welding, or any other suitable means.

The embodiment shown in FIGS. 1–2 involves machining a central cavity 16 radially inward from the distal end 18. Alternately, more than one cavity can be used. Further, the single or multiple cavities can be machined radially outwardly from the bottom of the turbine disk.

Figure 3:
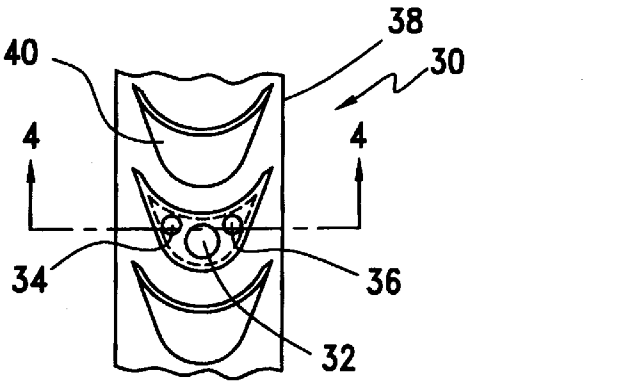
FIG. 3 is an end view of another embodiment of the turbine blade assembly of the present invention.
Figure 4:
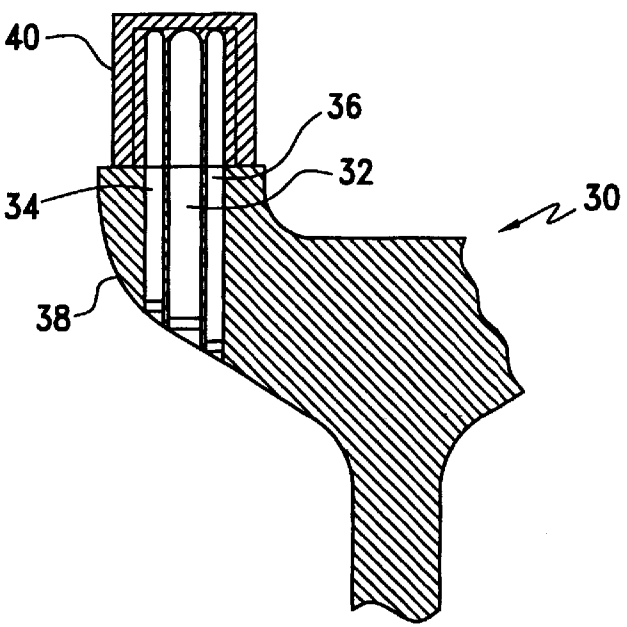
FIG. 4 is a cross-sectional view of the embodiment of FIG. 3, shown along Line 4—4 of FIG. 3.

Referring now to FIGS. 3 and 4, an alternate embodiment is illustrated, designated generally as 30. In this embodiment, three turbine blade damper cavities 32, 34, 36 are machined radially outward from the underside of the turbine disk 38 through the proximal end of the turbine blade 40. The use of a relatively large central cavity 32 and two smaller cavities 34, 36 allows maximal utilization of the volume of the turbine blade 40.

A primary advantage of the present invention is that the damper pins are completely contained within the turbine blade. There are no connections between blades that require external features to support the pins. Most present turbine blade dampers must span from blade to blade in order to use the relative motion between blades for damping. This generally restricts them to blade configurations that are mechanically attached to the disk because assembling a damper between blades requires the blades to be removable. External mounting configurations also leave the dampers exposed to the high velocity gas flow, which can lead to failure of the damper. This invention allows the damper elements, i.e. pins, to be placed within the turbine blade itself. These damper pins can be easily used on turbines with integral blades because installation of the damper cavity and pins do not require removal of the blade from the disk.

This invention can also be retrofitted to existing undamped turbine blisks. Major modification to the hardware is not required since additional material is not added to the blade to accommodate the damper cavity and pins. The retrofit only requires removing material from the blade. The modification involves making the cavity in the blade, installing the damping pins, and closing the cavity. Lead-time to get back into testing is reduced since existing hardware can be modified as opposed to waiting for a new production run of blades.

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. A turbine blade assembly for a turbine assembly, said turbine assembly being rotatable about a central axis, said turbine blade assembly comprising:

a) a turbine blade, having an internal surface defining a turbine blade damper cavity formed therein;

b) a plurality of pins positioned within said turbine blade damper cavity, said pins being contained within each turbine blade damper cavity during operation of the turbine blade assembly, wherein said plurality of pins reduce vibration of the turbine blade assembly during operation by dissipating energy by friction between adjacent pins and between said pins and said internal surface; and a damper cavity cap for supporting said plurality of pins.

2. The turbine blade assembly of claim 1, wherein said turbine blade damper cavity extends into said turbine blade substantially parallel to a turbine blade longitudinal axis, said turbine blade longitudinal axis extending substantially radially outward from said central axis.

3. The turbine blade assembly of claim 2, wherein said turbine blade longitudinal axis extends in a range of about 0°–10° from the radially outward direction from said central axis.

4. The turbine blade assembly of claim 2, wherein said turbine blade damper cavity extends in a range of about 0°–45° from said turbine blade longitudinal axis.

5. The turbine blade assembly of claim 1, wherein said turbine blade assembly further comprises a turbine disk, said turbine blade and turbine disk being integrally connected to form a turbine blisk.

6. The turbine blade assembly of claim 1, wherein each said turbine blade assembly further comprises a turbine disk, said turbine blade and turbine disk being attached to each other.

7. The turbine blade assembly of claim 1, wherein said turbine blade assembly further comprises a turbine disk, said turbine blade depending from said turbine disk, said damper cavity extending partially into said turbine disk.

8. The turbine blade assembly of claim 1, wherein said plurality of pins are contained within said turbine blade damper cavity by a snug fit.

9. The turbine blade assembly of claim 1, wherein said turbine blade damper cavity extends into said turbine blade from a distal end of said turbine blade opposite a turbine disk of said turbine blade assembly.

10. The turbine blade assembly of claim 1, wherein said turbine blade assembly further comprises a turbine disk, said turbine blade depending from said turbine disk, said turbine blade damper cavity extending from an opening in said turbine disk into said turbine blade, thus allowing for the introduction of said plurality of pins from the underside of said turbine blade.

11. The turbine blade assembly of claim 1, wherein said plurality of pins comprise solid pins.

12. The turbine blade assembly of claim 1, wherein said plurality of pins have hexagonal cross-sections.

13. The turbine blade assembly of claim 1, wherein said plurality of pins have round cross-sections.

14. The turbine blade assembly of claim 1, wherein said plurality of pins have irregular cross sections.

15. The turbine blade assembly of claim 1, wherein said plurality of pins have square cross-sections.

16. The turbine blade assembly of claim 1, further comprising at least one additional blade damper cavity for supporting additional pluralities of pins.

17. The turbine blade assembly of claim 1, wherein said pins have diameters in a range of between about 0.010 and 0.050 inches.

18. The turbine blade assembly of claim 1, wherein each of said pin has a diameter of about 0.020 inches.

19. The turbine blade assembly of claim 1, wherein said turbine blade comprises additional damper cavities, each containing additional sets of pins to provide maximal utilization of the volume of said turbine blade.

20. The turbine blade assembly of claim 19, wherein a relatively large central damper cavity and two smaller adjacent cavities are used.

21. A turbine blade assembly for a turbine assembly, said turbine assembly being rotatable about a central axis, said turbine blade assembly comprising:

a) a turbine blade, having a turbine blade damper cavity formed therein, said turbine blade damper cavity extending into said turbine blade substantially along a longitudinal axis thereof, said longitudinal axis extending near radially outward from said central axis; and b) a plurality of pins positioned within said turbine blade damper cavity parallel to said longitudinal axis of said turbine blade damper cavity, said pins being contained within said turbine blade damper cavity during operation of the turbine blade assembly, wherein said plurality of pins reduce vibration of the turbine blade assembly during operation by dissipating energy by friction between adjacent of said pins and between said pins and said internal surface; and a damper cavity cap for supporting said plurality of pins.

22. The turbine blade assembly of claim 21, wherein said turbine blade assembly further comprises a turbine disk, said turbine blade and turbine disk being integrally connected to form a turbine blisk.

23. The turbine blade assembly of claim 21, wherein said turbine blade assembly further comprises a turbine disk, said turbine blade and turbine disk being attached to each other.

24. The turbine blade assembly of claim 21, wherein said turbine blade assembly further comprises a turbine disk, said turbine blade depending from said turbine disk, said damper cavity extending partially into said turbine disk.

25. The turbine blade assembly of claim 21, wherein said plurality of pins are contained within each said turbine blade damper cavity by a snug fit.

26. The turbine blade assembly of claim 21, wherein said turbine blade damper cavity extends into said turbine blade from a distal end of said turbine blade opposite a turbine disk of said turbine blade assembly.

27. The turbine blade assembly of claim 21, wherein said turbine blade assembly further comprises a turbine disk, said turbine blade depending from said turbine disk, said turbine blade damper cavity extending from an opening in said turbine disk into said turbine blade, thus allowing for the introduction of said plurality of pins from the underside of said turbine blade.

28. The turbine blade assembly of claim 21, wherein said plurality of pins comprise solid pins.

29. The turbine blade assembly of claim 21, wherein said plurality of pins have hexagonal cross-sections.

30. The turbine blade assembly of claim 21, wherein said plurality of pins have round cross-sections.

31. The turbine blade assembly of claim 21, wherein said plurality of pins have irregular cross sections.

32. The turbine blade assembly of claim 21, wherein said plurality of pins have square cross-sections.

33. The turbine blade assembly of claim 21, further comprising at least one additional blade damper cavity for supporting additional pluralities of pins.

34. The turbine blade assembly of claim 21, wherein said pins have diameters in a range of between about 0.010 and 0.050 inches.

35. The turbine blade assembly of claim 21, wherein each of said pin has a diameter of about 0.020 inches.

36. A turbine blade assembly for a turbine assembly, said turbine assembly being rotatable about a central axis, said turbine blade assembly comprising:

a) a turbine disk;

b) a plurality of turbine blades extending from said turbine disk, each turbine blade having an internal surface defining a turbine blade damper cavity formed therein; and c) a plurality of elongated pins positioned within each of said respective turbine blade damper cavities, said elongated pins being contained within each turbine blade damper cavity and being in contact with at least some adjacent pins along elongated, adjacent peripheral surfaces thereof during operation of the turbine blade assembly, wherein said plurality of pins reduce vibration of the turbine blade assembly during operation by dissipating energy by friction between adjacent pins within a respective damper cavity and between said pins and said internal surface.

37. The turbine blade assembly of claim 36, wherein the plurality of elongated pins include one or more cylindrical pins, said cylindrical pins being in contact with at least some adjacent pins along elongated, cylindrical peripheral surfaces thereof.

38. The turbine blade assembly of claim 36, wherein each of the plurality of elongated pins is elongated along a longitudinal axis, said elongated axes being approximately parallel.

39. The turbine blade assembly of claim 36, wherein said turbine blade assembly further comprises a damper cavity cap for supporting said plurality of pins.

40. The turbine blade assembly of claim 36, wherein said plurality of pins are contained within each said turbine blade damper cavity by a snug fit.

41. The turbine blade assembly of claim 36, wherein said plurality of pins have round cross-sections.

42. A method for reducing the vibration of a turbine blade assembly of a turbine assembly during operation, said turbine assembly being rotatable about a central axis, comprising the steps of:

a) forming openings in selected turbine blades so as to provide internal surfaces defining turbine blade damper cavities within said selected turbine blades;

b) positioning a plurality of elongated pins within each of said damper cavities;

c) containing said elongated pins within each damper cavity during operation of said turbine blade assembly; and d) contacting at least some adjacent pins along elongated, adjacent peripheral surfaces thereof, wherein said plurality of elongated pins reduce vibration of the turbine blade assembly during operation by dissipating energy by friction between adjacent pins within a respective damper cavity and between said elongated pins and said internal surface.

43. The method of claim 42, wherein positioning a plurality of elongated pins within each of said damper cavities includes positioning one or more cylindrical pins within at least one damper cavity, said cylindrical pins being in contact with at least some adjacent pins along elongated, cylindrical peripheral surfaces thereof.

44. The method of claim 42, wherein positioning a plurality of elongated pins within each of said damper cavities includes positioning one or more elongated pins, wherein each elongated pin is elongated along a longitudinal axis, said elongated axes being approximately parallel.

45. The method of claim 42, further comprising providing a damper cavity cap for supporting said plurality of pins.

46. The method of claim 42, wherein positioning a plurality of elongated pins within each of said damper cavities includes positioning one or more elongated pins in a snug fitting arrangement.

47. The method of claim 42, wherein positioning a plurality of elongated pins within each of said damper cavities includes positioning one or more elongated pins having round cross-sections.

48. A turbine blade assembly for a turbine assembly, said turbine assembly being rotatable about a central axis, said turbine blade assembly comprising:

a) a turbine blade, having an internal surface defining a turbine blade damper cavity formed therein;

b) a plurality of pins positioned within said turbine blade damper cavity, said pins being contained within each turbine blade damper cavity during operation of the turbine blade assembly, wherein said plurality of pins reduce vibration of the turbine blade assembly during operation by dissipating energy by friction between adjacent pins and between said pins and said internal surface; and a turbine disk, said turbine blade depending from said turbine disk, said damper cavity extending partially into said turbine disk.

49. The turbine blade assembly of claim 48, wherein said turbine blade assembly further comprises a damper cavity cap for supporting said plurality of pins.

50. The turbine blade assembly of claim 48, wherein said plurality of pins are contained within each said turbine blade damper cavity by a snug fit.

51. The turbine blade assembly of claim 48, wherein said plurality of pins have round cross-sections.

52. The turbine blade assembly of claim 48, further comprising at least one additional blade damper cavity for supporting additional pluralities of pins.

53. A turbine blade assembly for a turbine assembly, said turbine assembly being rotatable about a central axis, said turbine blade assembly comprising:

a) a turbine blade, having an internal surface defining a turbine blade damper cavity formed therein; and b) a plurality of pins positioned within said turbine blade damper cavity, said pins being contained within each turbine blade damper cavity during operation of the turbine blade assembly, wherein said plurality of pins are contained within each said turbine blade damper cavity by a snug fit, and wherein said plurality of pins reduce vibration of the turbine blade assembly during operation by dissipating energy by friction between adjacent pins and between said pins and said internal surface.

54. The turbine blade assembly of claim 53, wherein said turbine blade assembly further comprises a damper cavity cap for supporting said plurality of pins.

55. The turbine blade assembly of claim 53, further comprising a turbine disk, said turbine blade depending from said turbine disk, said damper cavity extending partially into said turbine disk.

56. The turbine blade assembly of claim 53, wherein said plurality of pins have round cross-sections.

57. The turbine blade assembly of claim 53, further comprising at least one additional blade damper cavity for supporting additional pluralities of pins.

58. A turbine blade assembly for a turbine assembly, said turbine assembly being rotatable about a central axis, said turbine blade assembly comprising:

a) a turbine blade, having an internal surface defining a turbine blade damper cavity formed therein; and b) a plurality of elongated pins positioned within said turbine blade damper cavity, said elongated pins being contained within each turbine blade damper cavity during operation of the turbine blade assembly and being in contact with at least some adjacent pins along elongated, adjacent peripheral surfaces thereof, wherein said plurality of pins have round cross-sections, and wherein said plurality of pins reduce vibration of the turbine blade assembly during operation by dissipating energy by friction between adjacent pins and between said pins and said internal surface.

59. The turbine blade assembly of claim 58, wherein said turbine blade assembly further comprises a damper cavity cap for supporting said plurality of pins.

60. The turbine blade assembly of claim 58, further comprising a turbine disk, said turbine blade depending from said turbine disk, said damper cavity extending partially into said turbine disk.

61. The turbine blade assembly of claim 58, wherein said plurality of pins are contained within each said turbine blade damper cavity by a snug fit.

62. The turbine blade assembly of claim 58, further comprising at least one additional blade damper cavity for supporting additional pluralities of pins.

63. A turbine blade assembly for a turbine assembly, said turbine assembly being rotatable about a central axis, said turbine blade assembly comprising:

a) a turbine blade, having an internal surface defining a turbine blade damper cavity formed therein;

b) a plurality of pins positioned within said turbine blade damper cavity, said pins being contained within each turbine blade damper cavity during operation of the turbine blade assembly, wherein said plurality of pins reduce vibration of the turbine blade assembly during operation by dissipating energy by friction between adjacent pins and between said pins and said internal surface; and c) at least one additional blade damper cavity for supporting additional pluralities of pins.

64. The turbine blade assembly of claim 63, wherein said turbine blade assembly further comprises a damper cavity cap for supporting said plurality of pins.

65. The turbine blade assembly of claim 63, further comprising a turbine disk, said turbine blade depending from said turbine disk, said damper cavity extending partially into said turbine disk.

66. The turbine blade assembly of claim 63, wherein said plurality of pins are contained within each said turbine blade damper cavity by a snug fit.

67. The turbine blade assembly of claim 63, wherein said plurality of pins have round cross-sections.

68. A turbine blade assembly for a turbine assembly, said turbine assembly being rotatable about a central axis, said turbine blade assembly comprising:

a) a turbine blade, having a turbine blade damper cavity formed therein, said turbine blade damper cavity extending into said turbine blade substantially along a longitudinal axis thereof, said longitudinal axis extending near radially outward from said central axis;

b) a turbine disk, said turbine blade depending from said turbine disk, said damper cavity extending partially into said turbine disk; and c) a plurality of pins positioned within said turbine blade damper cavity parallel to said longitudinal axis of said turbine blade damper cavity, said pins being contained within said turbine blade damper cavity during operation of the turbine blade assembly, wherein said plurality of pins reduce vibration of the turbine blade assembly during operation by dissipating energy by friction between adjacent of said pins and between said pins and said internal surface.

69. The turbine blade assembly of claim 68, wherein said turbine blade assembly further comprises a damper cavity cap for supporting said plurality of pins.

70. The turbine blade assembly of claim 68, wherein said plurality of pins are contained within each said turbine blade damper cavity by a snug fit.

71. The turbine blade assembly of claim 68, wherein said plurality of pins have round cross-sections.

72. The turbine blade assembly of claim 68, further comprising at least one additional blade damper cavity for supporting additional pluralities of pins.

73. A turbine blade assembly for a turbine assembly, said turbine assembly being rotatable about a central axis, said turbine blade assembly comprising:

a) a turbine blade, having a turbine blade damper cavity formed therein, said turbine blade damper cavity extending into said turbine blade substantially along a longitudinal axis thereof, said longitudinal axis extending near radially outward from said central axis; and b) a plurality of pins positioned within said turbine blade damper cavity parallel to said longitudinal axis of said turbine blade damper cavity, said pins being contained within said turbine blade damper cavity during operation of the turbine blade assembly, wherein said plurality of pins are contained within each said turbine blade damper cavity by a snug fit, and wherein said plurality of pins reduce vibration of the turbine blade assembly during operation by dissipating energy by friction between adjacent of said pins and between said pins and said internal surface.

74. The turbine blade assembly of claim 73, wherein said turbine blade assembly further comprises a damper cavity cap for supporting said plurality of pins.

75. The turbine blade assembly of claim 73, wherein said turbine blade assembly further comprises a turbine disk, said turbine blade depending from said turbine disk, said damper cavity extending partially into said turbine disk.

76. The turbine blade assembly of claim 73, wherein said plurality of pins have round cross-sections.

77. The turbine blade assembly of claim 73, further comprising at least one additional blade damper cavity for supporting additional pluralities of pins.

78. A turbine blade assembly for a turbine assembly, said turbine assembly being rotatable about a central axis, said turbine blade assembly comprising:

a) a turbine blade, having a turbine blade damper cavity formed therein, said turbine blade damper cavity extending into said turbine blade substantially along a longitudinal axis thereof, said longitudinal axis extending near radially outward from said central axis; and b) a plurality of elongated pins positioned within said turbine blade damper cavity parallel to said longitudinal axis of said turbine blade damper cavity, said elongated pins being contained within said turbine blade damper cavity during operation of the turbine blade assembly and being in contact with at least some adjacent pins along elongated, adjacent peripheral surfaces thereof, wherein said plurality of pins have round cross-sections, and wherein said plurality of pins reduce vibration of the turbine blade assembly during operation by dissipating energy by friction between adjacent of said pins and between said pins and said internal surface.

79. The turbine blade assembly of claim 78, wherein said turbine blade assembly further comprises a damper cavity cap for supporting said plurality of pins.

80. The turbine blade assembly of claim 78, wherein said turbine blade assembly further comprises a turbine disk, said turbine blade depending from said turbine disk, said damper cavity extending partially into said turbine disk.

81. The turbine blade assembly of claim 78, wherein said plurality of pins are contained within each said turbine blade damper cavity by a snug fit.

82. The turbine blade assembly of claim 78, further comprising at least one additional blade damper cavity for supporting additional pluralities of pins.

83. A turbine blade assembly for a turbine assembly, said turbine assembly being rotatable about a central axis, said turbine blade assembly comprising:

a) a turbine blade, having a turbine blade damper cavity formed therein, said turbine blade damper cavity extending into said turbine blade substantially along a longitudinal axis thereof, said longitudinal axis extending near radially outward from said central axis;

b) a plurality of pins positioned within said turbine blade damper cavity parallel to said longitudinal axis of said turbine blade damper cavity, said pins being contained within said turbine blade damper cavity during operation of the turbine blade assembly, wherein said plurality of pins reduce vibration of the turbine blade assembly during operation by dissipating energy by friction between adjacent of said pins and between said pins and said internal surface, and c) at least one additional blade damper cavity for supporting additional pluralities of pins.

84. The turbine blade assembly of claim 83, wherein said turbine blade assembly further comprises a damper cavity cap for supporting said plurality of pins.

85. The turbine blade assembly of claim 83, wherein said turbine blade assembly further comprises a turbine disk, said turbine blade depending from said turbine disk, said damper cavity extending partially into said turbine disk.

86. The turbine blade assembly of claim 83, wherein said plurality of pins are contained within each said turbine blade damper cavity by a snug fit.

87. The turbine blade assembly of claim 83, wherein said plurality of pins have round cross-sections.

88. A turbine blade assembly for a turbine assembly, said turbine assembly being rotatable about a central axis, said turbine blade assembly comprising:

a) a turbine blade, having an internal surface defining a turbine blade damper cavity formed therein; and b) a plurality of elongated pins positioned within said turbine blade damper cavity, said elongated pins being contained within each turbine blade damper cavity and being in contact with at least some adjacent pins along elongated, adjacent peripheral surfaces thereof during operation of the turbine blade assembly, wherein said plurality of pins reduce vibration of the turbine blade assembly during operation by dissipating energy by friction between adjacent pins and between said pins and said internal surface.

89. The turbine blade assembly of claim 88, wherein said turbine blade assembly further comprises a turbine disk, said turbine blade depending from said turbine disk, said damper cavity extending partially into said turbine disk.

90. The turbine blade assembly of claim 88, wherein said turbine blade assembly further comprises a damper cavity cap for supporting said plurality of pins.

91. The turbine blade assembly of claim 88, wherein said plurality of pins are contained within each said turbine blade damper cavity by a snug fit.

92. The turbine blade assembly of claim 88, wherein said plurality of pins have round cross-sections.

93. The turbine blade assembly of claim 88, further comprising at least one additional blade damper cavity for supporting additional pluralities of pins.

94. The turbine blade assembly of claim 88, wherein the plurality of elongated pins include one or more cylindrical pins, said cylindrical pins being in contact with at least some adjacent pins along elongated, cylindrical peripheral surfaces thereof.

* * * * *